United States Patent [19]

Gustafsson

[11] 3,993,110

[45] Nov. 23, 1976

[54] METHOD OF DIFFUSING GAS INTO A SEALED VESSEL AND A DEVICE FOR CARRYING OUT THE METHOD

[75] Inventor: Sven Gustaf Gustafsson, Enskede, Sweden

[73] Assignee: Telefonaktiebolaget L M Ericsson, Stockholm, Sweden

[22] Filed: Feb. 12, 1975

[21] Appl. No.: 549,155

[30] Foreign Application Priority Data

Feb. 27, 1974 Sweden ..... 74025644

[52] U.S. Cl. ..... 141/4; 141/66

[51] Int. Cl.[2] ..... B65B 3/04; B67C 3/12

[58] Field of Search ..... 141/8, 65, 66, 4, 1–12, 141/37, 47

[56] References Cited

UNITED STATES PATENTS 3,108,621 10/1963 Harries ..... 141/8

*Primary Examiner*—Houston S. Bell, Jr.

*Attorney, Agent, or Firm*—Hane, Baxley & Spiecens

[57] ABSTRACT

There is disclosed a method of diffusing gaseous medium such as tritium into a vessel such as a tube of an overvoltage protector. According to the method, a vessel such as a tube including a wall portion made of a material permitting diffusion of gas therethrough is provided. This vessel is heated to a predetermined elevated temperature and sealed while the vessel is at the elevated temperature. The vessel is thereupon evacuated and exposed to an atmosphere of gas to be diffused into the vessel while maintaining this atmosphere for a predetermined period of time at an elevated temperature less than the sealing temperature and at a pressure higher than the pressure within the sealed and evacuated vessel, thereby causing diffusion of gas into the vessel for filling the same with the gas. There is also disclosed a device for carrying out the hereinbefore described method.

7 Claims, 2 Drawing Figures

METHOD OF DIFFUSING GAS INTO A SEALED VESSEL AND A DEVICE FOR CARRYING OUT THE METHOD

The invention relates to a method for introducing radioactive gas, preferably tritium, into a vacuum sealed closed vessel, for example a gas-filled overvoltage protector without using any pump pipes. Tritium acts in this connection in known manner as ionizing radiation medium which serves to stabilize the striking voltage of the overvoltage protector.

The proposed method makes possible the re-use of the radioactive gas which is supplied to the charging system of the production process. The re-use has essential advantages, among others, that the loss or escape of tritium can be substantially eliminated.

The hitherto known method to apply tritium in a gas discharge tube is based on the use of tritium as an addition to the filling gas. The method is applicable without great difficulties when producing discharge tubes provided with pump pipes. The gas filling occurs individually via the pump pipe which during the filling procedure is connected to a completely closed gas filling system. Any escape of radioactive gas cannot occur.

Gas discharge tubes without pump pipes are gas filled and simultaneously closed in great numbers in one and the same operation sequence in a closed sealing oven. This filling method saves work but substantial quantities of excess gas have to be evacuated after each gas filling-sealing procedure. As the filling gas is polluted when sealing it can not without a complicated filtration procedure be reused but has to be discharged via ventilation arrangements to the surroundings. Overvoltage protectors can contain a tritium concentration up to 10 $\mu Ci/mm^3 = 10{,}000\ Ci/m^3$, whereby this filling method entails great difficulties to obtain limitation of the total loss or escape of tritium as well as of the tritium concentration in the venting air.

The proposed filling method is based on the premise that light gases for example helium, hydrogen, tritium, and so on can diffuse through solid material such as glass, ceramic, metals and so on. The total gas quantity q which at constant temperature penetrates a wall of glass or ceramic is determined by the relation $$q = A/d\ K\ t\ (P_1 - p_2)$$

where $A$ = the area of the wall
$d$ = the thickness of the wall
$K$ = the constant of the penetration speed
$t$ = time
$P_1 - p_2$ = the difference in pressure between high- and low pressure side K is a temperature dependent function of the type $$K = C\ e^{+Q/RT}$$

where $C$ = a constant
$Q$ = the activation energy of the wall material
$R$ = the gas constant
$T$ = the temperature in K By suitable choice of the parameters pressure, temperature and time for the filling procedure a desired quantity of tritium can consequently be caused to diffuse into a vacuum sealed vessel at the room temperature and having walls which at least partly consist of glass or ceramic.

The tritium preparation of for example overvoltage protection is carried out according to the invention in a vacuum sealed reaction vessel which via a ventilation system is connected on one hand to a vacuum pump and on the other hand to a container with tritium. The reaction vessel is provided with an outer heating arrangement. The tritium container can be a reversible getter pump, usually a so called "uranium furnace".

The invention is described more in detail in the following with reference to FIGS. 1 and 2.

Figure 1:
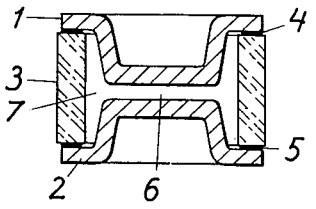
FIG. 1 shows an example of a gas filling vessel constituting as overvoltage protector, the construction of which permits the application of the charge method according to the invention.

In the overvoltage protector, which is shown in FIG. 1, two metal electrodes 1 and 2 provided with flanges and with a ring shaped insulator body 3 form a gas sealed discharge vessel. The electrodes and the insulator are gas sealed joined by means of hard-soldered connections 4 and 5 between the flanges of the electrodes and the sintered metal coverings on the end surfaces of the insulator ring. The height of the insulator ring and the two electrodes inserted in the discharge space are so dimensioned that the distance between the circular surfaces facing each other in known manner forms a discharge distance 6 the length of which together with the gas pressure determine the striking voltage of the overvoltage protector. Evacuation, gas-filling and closing of the discharge vessel occur in an operation sequence in a closed soldering oven. The gas-filling 7 comprises tritium as preionization medium which preferably via the insulation wall is diffused into the charge space after the joining.

Figure 2:
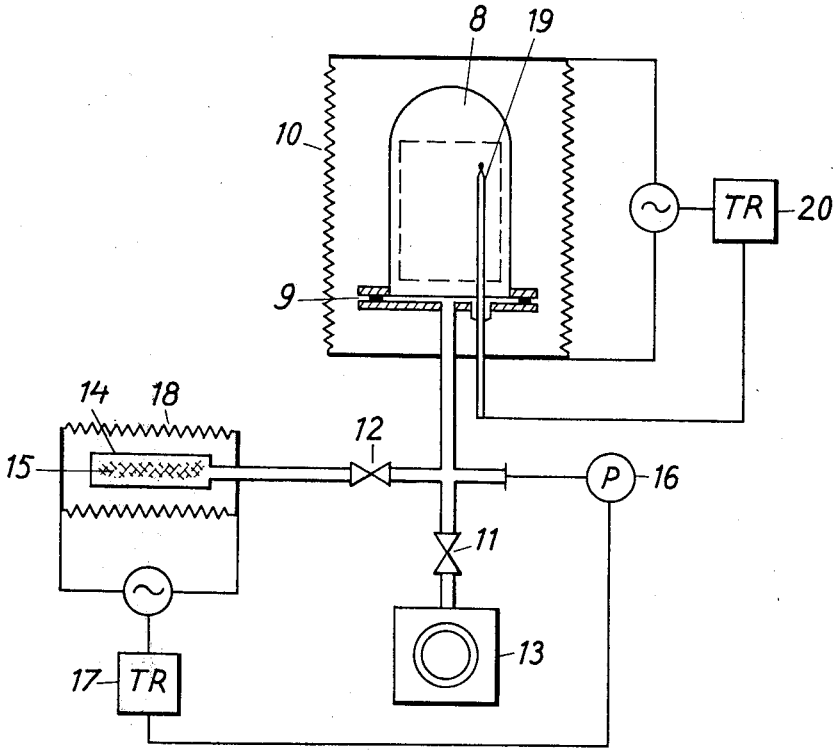
FIG. 2 shows schematically an example of equipment for tritium filling according to the invention.

Tritium preparation occurs in an arrangement which is diagrammatically shown in FIG. 2. The overvoltage protectors 25 to be processed are in a reaction vessel 8 which is provided with a dismountable flange coupling 9 with metal insert and an electrical resistance element 10 serving as an outer heating source. Vacuum valves 11 and 12 permit selective connection of a vacuum pump 13 and a reversible getter pump 14 functioning as tritium container. The getter pump 14 contains powder 15 of hydride forming metal, preferably uranium. The tritium pressure in the system is measured with a manometer 16 and is regulated by adjustment of a temperature regulator 17 which controls the effect to a resistance element 18. The temperature in the reaction vessel 8 is measured with a termoelement 19 and is regulated by adjustment of a temperature regulator 20 which controls the effect generated by the resistance element 10.

The preparation procedure occurs in three steps.

1. Degassing of the overvoltage projector tubes in vacuum.
2. Preparation in the tritium atmosphere. Adjustment of pressure, temperature and time is determined by the desired quantity of diffused-in tritium and by the wall structure of the tubes.

Degassing of the outer surfaces of the tubes in neutral atmosphere and at room temperature.

As an example can be mentioned that closure of the tubes occurs at the temperature 800° C, after which the degassing occurs at 400° C and diffusion of tritium gas occurs at a pressure of 10–50 Torr., at a temperature of 400°–500° C and for 2–10 hours. If particularly advantageous pressure, temperature and time value are chosen such as 30 Torr., 450° C and 5 hours respectively, a tritium activity of 10–100 $\mu$Ci/mm$^3$ is obtained in dependence on the wall structure.

We claim:

1. A method of diffusing gaseous medium into a vessel, said method comprising the steps of:

providing a vessel including a wall portion made of a material permitting diffusion of gas therethrough;

then heating the vessel to a predetermined elevated temperature and sealing the vessel while being at said elevated temperature;

evacuating said vessel at an elevated temperature; and exposing the evacuated and sealed vessel for a predetermined period of time to an atmosphere of gas to be diffused into the vessel while maintaining said atmosphere for said predetermined period of time at an elevated temperature less than the temperature at which the vessel is sealed and at a gas pressure higher than the pressure within the evacuated sealed vessel, thereby causing diffusion of the gas into the vessel for filling the same with said gas.

2. A method as claimed in claim 1 wherein said vessel is sealed at a temperature of about 800° C. and evacuated at about 400° C., said atmosphere of gas is maintained for a period of 2 to 10 hours at a temperature of 400° to 500° C. and a pressure of 10–50 Torr., the vacuum pressure within the vessel being lower than the gas pressure of said atmosphere of gas.

3. A method as claimed in claim 2 wherein the pressure of the gas atmosphere is maintained at about 30 Torr. and the temperature of the gas atmosphere at about 450° C., and wherein the period of time for diffusion is about 5 hours.

4. A method as claimed in claim 1 and comprising the step of degassing the outer surface of the vessel after completion of the diffusion of gas.

5. A method as claimed in claim 1 wherein said gas is tritium.

6. A device for diffusing a gaseous medium into a vessel having a wall portion permitting diffusing of gaseous medium therethrough, said device comprising in combination:

a closable reaction container for placing therein a vessel to be filled with gas;

external heating means for heating said vessel from the outside to a selected elevated temperature;

a vacuum pump means for evacuating the vessel placed in said container;

gas supply pump means for supplying gas into said container;

valve means for selectively activating either one of said pump means, said pump means including a receptacle for gas releasing material, heat generating means for heating said receptacle, and control means for controlling the heat and pressure in said receptacle, thereby selectively varying the volume of gas released from said receptacle; and valve means for selectively connecting either of said pump means to said reaction container.

7. A device according to claim 6 and comprising control means for controlling the heat generated in said reaction container by said external heating means.

* * * * *